United States Patent [19]

Geiger

[11] 4,128,953

[45] Dec. 12, 1978

[54] IRONING MANGLE WITH PNEUMATICALLY PRESSURIZABLE ROLLER COVERING

[75] Inventor: Friedrich Geiger, Augsburg, Germany

[73] Assignee: Firma Kleindienst & Co. Maschinenfabrik, Augsburg, Germany

[21] Appl. No.: 871,473

[22] Filed: Jan. 23, 1978

[30] Foreign Application Priority Data

Jan. 21, 1977 [DE] Fed. Rep. of Germany ..... 2702472

[51] Int. Cl.[2] ..... D06F 63/00; D06F 71/36; D06F 83/00

[52] U.S. Cl. ..... 38/56; 38/66

[58] Field of Search ..... 38/44, 56, 57, 58–62, 38/64, 66, 140

[56] References Cited

U.S. PATENT DOCUMENTS

| | | | |
|---|---|---|---|
| 3,157,723 | 11/1964 | Hochberg | 38/56 X |
| 3,878,627 | 4/1975 | Mazzolla | 38/56 |
| 3,950,867 | 4/1976 | Mazzolla | 38/66 |
| 3,961,430 | 6/1976 | Mazzolla | 38/66 |

FOREIGN PATENT DOCUMENTS

| | | | |
|---|---|---|---|
| 1394281 | 2/1965 | France | 38/56 |

*Primary Examiner*—Louis K. Rimrodt
*Attorney, Agent, or Firm*—Karl F. Ross

[57] ABSTRACT

An ironing mangle has a generally cylindrical and tubular roller received within a generally cylindrical tube that surrounds it through more than 270°. A plurality of cushions or bags is secured to the outer surface of the roller, the bags being angularly offset and angularly overlapping each other. These bags can be pneumatically pressurized to force items being ironed against the inner surface of the sleeve. A cover sheet extending circumferentially completely around the roller is secured to the roller at its leading edge underneath one of the bags and is gas-pervious. Similarly the bags are provided with tubular throughgoing fittings that allow gas passage through the bags without depressurization of them, while the surfaces of these bags are formed with a plurality of bumps and the roller has throughgoing holes that allow the interior of the roller to be depressurized to draw off steam generated during ironing.

15 Claims, 5 Drawing Figures

IRONING MANGLE WITH PNEUMATICALLY PRESSURIZABLE ROLLER COVERING

FIELD OF THE INVENTION

The present invention relates to a pressing apparatus. More particularly, this invention concerns an ironing mangle.

BACKGROUND OF THE INVENTION

An ironing mangle typically has a drum or roller which is at least partially received in a fixed pressing member that surrounds it through an arc of normally about 90°. In order to press the items to be ironed radially against this counter member as the roller rotates, it is necessary to provide an elastic covering on the roller. U.S. Pat. No. 3,961,430 has suggested replacing the normal felt cover with a cover constituted by a relatively large elastic bag or bladder received within an inelastic element. This item is secured to the outer surface of the drum and wrapped completely around it. Such an arrangement has been found to have the considerable disadvantage that the covering bulges out at that location where the roller is not immediately juxtaposed with the counter member, so that it wears out rapidly and is only partially effective where it does press the items being ironed against the counter member.

It has also been suggested by French Pat. No. 1,394,281 to constitute the counter member as a sleeve which surrounds most of the roller. The combination of this arrangement with the above-described system of U.S. Pat. No. 3,961,430 has not been possible since it is necessary in accordance with the U.S. patent to let the pneumatic covering member bulge out at at least one location so that wrinkles are not present elsewhere in this pneumatic covering. If the pneumatic covering were confined over almost all of the roller such wrinkling would be inevitable and would appear in the items being ironed. Furthermore this system would make it very difficult to aspirate steam from inside the roller, and would similarly apply considerable stresses to the pneumatic covering that would assuredly very quickly wear it out.

OBJECTS OF THE INVENTION

It is therefore an object of the present invention to provide an improved pressing apparatus, in particular one usable as an ironing mangle.

Another object is the provision of such an apparatus which allows the application of the pneumatic covering to a system wherein a relatively long ironing path is provided and also wherein steam aspiration is possible throughout the ironing path.

Yet another object is to provide such a system which has a long service life and which is easy to operate.

SUMMARY OF THE INVENTION

These objects are attained according to the present invention in a system such as that described above, but wherein a plurality of cushions is provided, each having an inelastic inner wall lying mainly on the outer surface of the drum, an inelastic outer wall between the respective inner wall and the inner surface of the sleeve surrounding the drum, and a sealed periphery defining between these walls a pressurizable chamber.

According to this invention each of these cushions is secured relative to the rotational sense of the roller at its leading edge only to the roller, and overlaps at its trailing edge the leading edge of the following cushion. Thus the entire periphery of the roller is provided with a pneumatic covering, but each covering only overlies a fraction of the surface area of the roller. Thus the strain at the attachment location of any single cushion is relatively small so that an extremely long service life is obtained. Furthermore since the cushions are relatively short measured circumferentially and are formed of inelastic material they will inherently lie perfectly flat, overlapping one another as described above, and therefore prevent the formation of wrinkles in the items being ironed. Such wrinkle-formation is further reduced according to this invention by overlying the outer walls of all of these cushions with a single cover sheet of felt, molton, or similar compressible and gas-pervious material. This cover sheet itself is secured only at its leading edge to the drum and at a location underlying one of the cushions, so that telegraphing of any surface irregularities to the items being ironed is completely ruled out.

According to further features of this invention the roller is cylindrically tubular and is formed on its surface with a multiplicity of angularly and axially spaced throughgoing holes. The surfaces of the inner and/or outer walls of the pneumatic cushions are formed with alternate bumps and recesses. Thus if the interior of the roller is aspirated steam flow radially inwardly past the cushions and through the roller will be possible. Such steam aspiration is further aided by providing each of the cushions with a plurality of throughgoing fittings, each formed as a radially extending bellows-like tube having an inner end sealed to the inner wall of the respective cushion, an outer end sealed to a respective outer wall of the respective cushion, and forming a throughgoing passage extending through the cushion but not communicating with its interior. Thus even in an air-pressure system good steam aspiration is possible even though the cushions or bags have walls constituted of gas-impervious and inelastic sheet material.

In the system according to this invention the sleeve surrounds the roller by more than 180°, preferably more than 270°. This greatly increases the treatment path for items being ironed, and is easily possible in this system wherein no bulging-out of the pneumatic bags need be allowed for in order to prevent wrinkle formation.

According to yet another feature of this invention an endless pressing band has a stretch guided over the surrounded portion of the roller and normally lying between the items being pressed and the cover sheet of the roller. To this end the pressing band may be constituted of thin and inelastic synthetic-resin material which is made gas-pervious either by perforation or by formation of an appropriate foraminous material.

In fact according to this invention it is possible to form the cushions or bags out of slightly elastic material, since their mounting at their leading edge means that during operation the bags will inherently be smooth and caused to lie perfectly flatly on the roller. Furthermore constituting the bags of such semielastic material means that the system can easily accept items having buttons or the like that normally present problems when ironing in a mangle.

The provision of a plurality of such bags not only means that in case of accidental puncturing or damaging of one of the bags it is possible merely to replace it, so that servicing costs are reduced, but also it is possible to use a relatively simple fastening of these elements, since none of them is subject to the considerable angular forces that a single such bag would be subject to if mounted alone.

SPECIFIC DESCRIPTION

Figure 1:
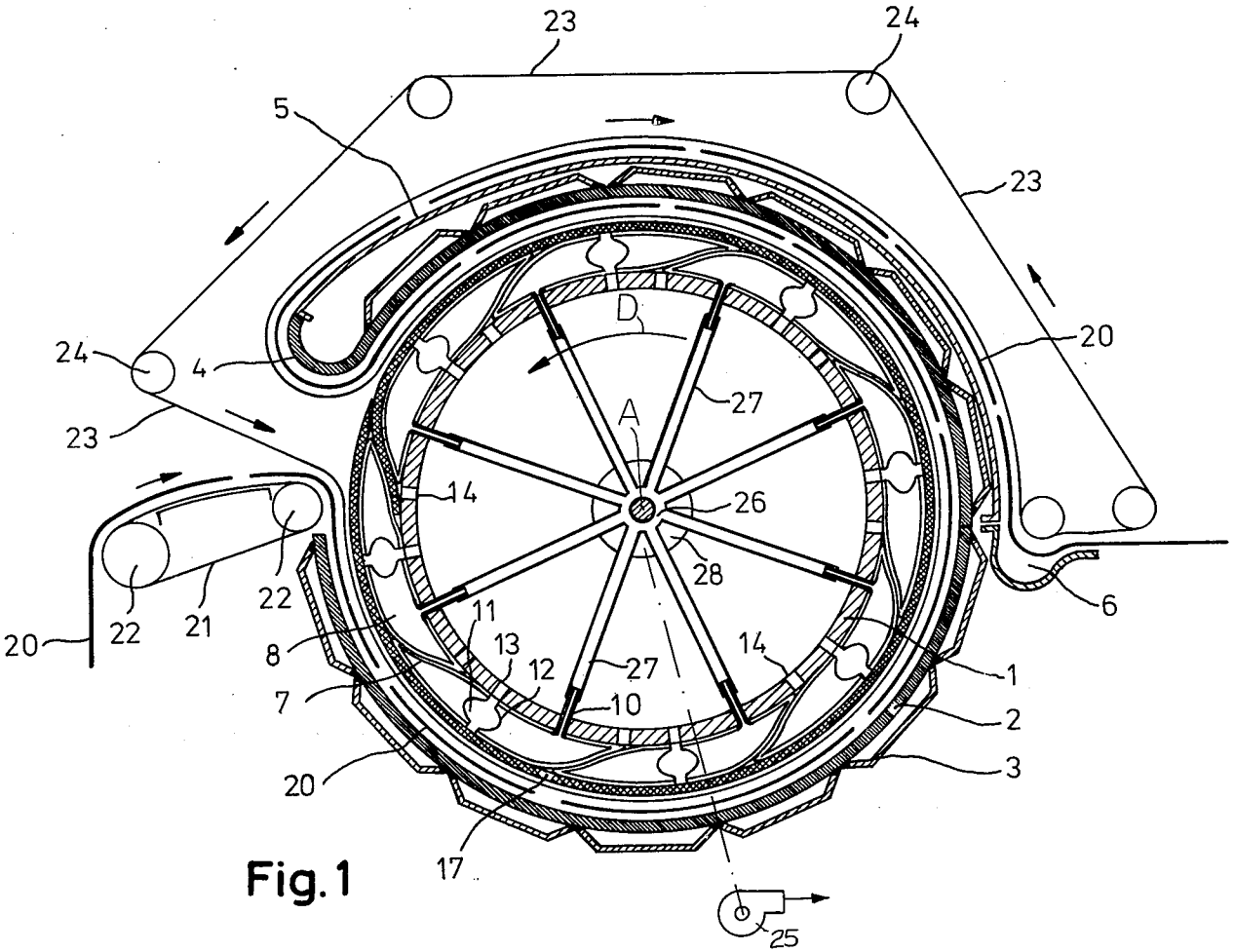
FIG. 1 is a vertical section through a mangle according to the instant invention.

As shown in FIG. 1 an ironing mangle according to the present invention basically comprises a cylindrically tubular roller or drum 1 centered on a horizontal axis A and surrounded by more than 270° by a fixed sleeve 2 also of generally cylindrical shape and centered on the axis A. The exterior of the sleeve is surrounded by a plurality of, here thirteen, heating devices or chambers 3 which extend the full axial length of the sleeve 2 which is identical to that of the roller 1. The sleeve 2 is formed at its outlet end relative to the direction D of rotation of the drum 1 with a semicylindrical backwardly bent lip 4 which joins an arcuate plate 5 that constitutes a smooth continuation of this lip 4 and extends back through approximately 150° over the sleeve 2. At its rear end the plate 5 is provided with bent-up section that constitutes an outlet 6.

Figure 4:
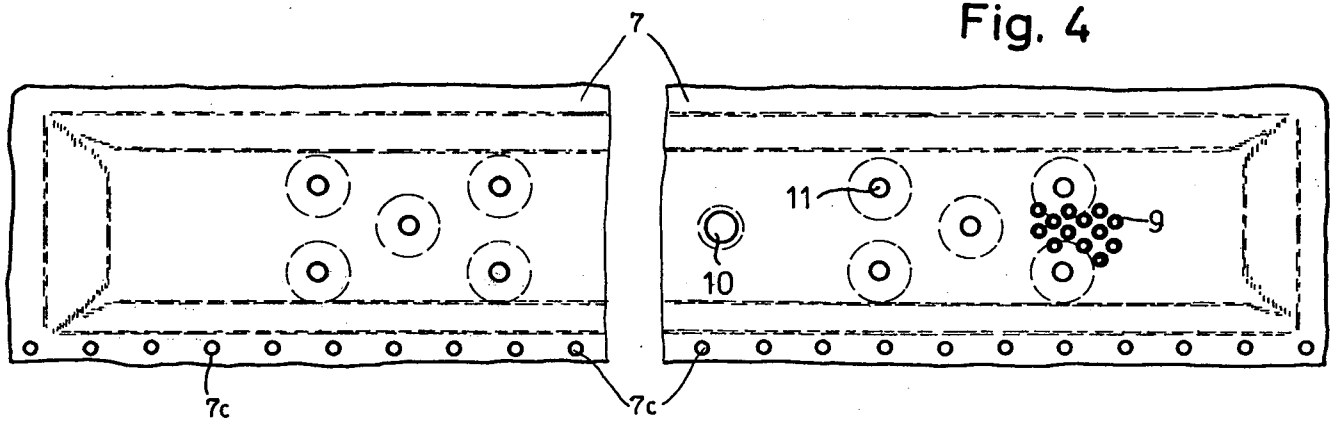
FIGS. 4 and 5 are top and side views of a cushion according to this invention.
Figure 5:
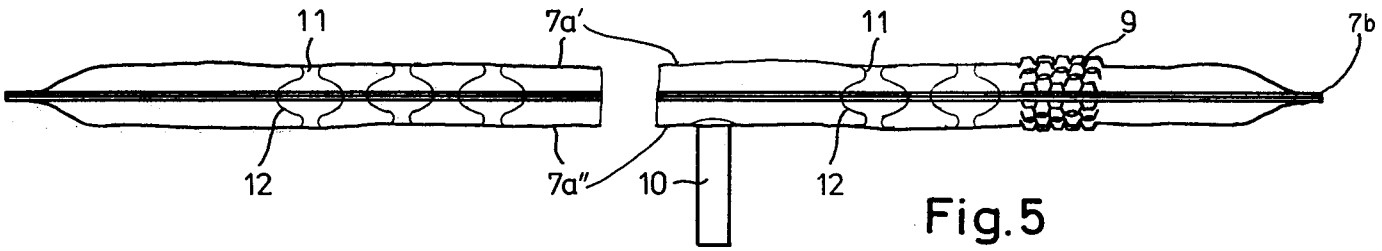

The roller 1 is provided with eight identical cushions or bags 7 shown in more detail in FIGS. 4 and 5 and each constituted by a rectangular outer wall 7*a'*, an identical rectangular inner wall 7*a''*, and a periphery 7*b* where the two walls 7*a'* and 7*a''* are permanently heat-sealed together. These walls 7*a'* and 7*a''* may be constituted of completely inelastic or slightly elastic material, but in any case are made of gas-impervious material so that they form a pressurizable chamber 8 (FIG. 1). Both of the walls 7*a'* and 7*a''* are formed with a multiplicity of bumps 9. The wall 7*a''* is provided with a nipple 10 whose function will be described below.

Figure 2:
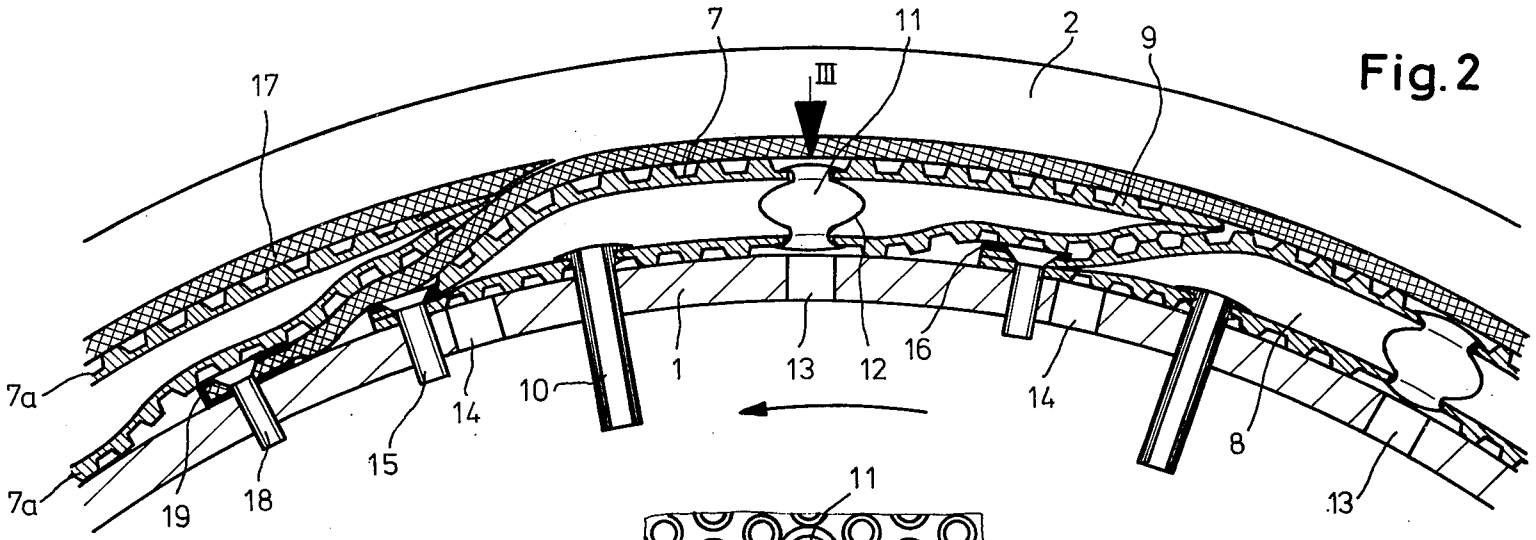
FIG. 2 is a large-scale view of a detail of the arrangement of FIG. 1.
Figure 3:
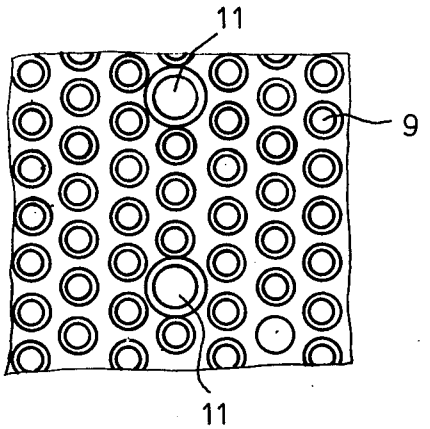
FIG. 3 is a top view taken in the direction of arrow III of FIG. 2.

In addition as also shown in FIGS. 2 and 3 each of the bags or cushions 7 is provided with a plurality of axially and angularly spaced throughgoing tubes 11 constituted as small one-section bellows and having outer ends sealed to the outer wall 7*a'* and inner ends secured to the inner wall 7*a''*. Thus these small tubes 11 which have bellied-out waists 12 so that they are readily axially compressible and extensible and form throughgoing passages through the bags 7 which do not communicate with the interiors 8 of these bags 7. The drum or roller 1 is formed with throughgoing radial holes 13 at locations which normally register with the throughgoing fittings 11.

Each of the bags 7 is formed along its periphery 7*b* on one of its long edges with a row of throughgoing holes 7*c* through which may be engaged threaded machine screws 15 that are threaded into the drum 1 along angularly offset lines of axially aligned holes having the same spacing as holes 7*c*. A metal holddown strip 16 is provided under the heads of the screws 15 to ensure excellent clamping of the leading edge of each of the bags 7. In addition the drum may be formed with further throughgoing holes 14 angularly and axially spaced throughout and whose function will be described below.

A felt or molton cover sheet 17 has a leading edge held within a U-shaped strip 19 and secured via machine screws 18 to the cylindrical roller 1 underneath the trailing edge of one bags 7. This cover sheet 17 has a circumferential length equal to somewhat more than the circumference of the roller 1 and a tapered rear end so that it overlies the entire roller 1 over the bags 7. Thus the outer walls 7*a'* of the bags 7 do not directly contact items 20 being ironed.

As further shown in FIG. 1 such items 20 to be ironed are fed in over an input belt 21 spanned over a pair of driven rollers 22 adjacent the upstream edge of the sleeve 2. To aid in guiding of the items 20 an endless very thin but gas-pervious band 23 is guided over the entire rotary inner assembly of the mangle constituted by the drum 1, bags 7 and cover sheet 17, and even extends back over the output formation 4 and return plate 5. Thus the items 20 are carefully held by this endless band 23 first against the inner periphery of the sleeve 2 and then against the outer surface of the return plate 5. Since the sleeve 2 and plate 5 are heated such items 20 when premoistened will be given an excellent ironing and all of the water in them will be effectively vaporized.

During such operation an internal pressure chamber 26 is maintained under superatmospheric pressure by a not-illustrated blower. Tubes 27 connect this chamber 26 to the nipples 10 so that the interiors 8 of the bags 7 are maintained under the desired pneumatic pressure to force the items 20 with the desired pressure against the sleeve 2.

At the same time as the interiors 8 are pressurized the interior of the roller 1 is evacuated by a blower 25 connected via a stuffing-box arrangement 28 to the opposite axial end of this drum 1 as the stuffing box for the manifold 26. Since the drum 1 is formed with throughgoing holes 13 and 14 evacuation of its interior will draw gas inwardly, both through the fittings 11 and simply around the bags 7. The provision of bumps and ridges 9 on these bags 7 prevents any of them from lying snugly on the holes 13 and 14 and blocking flow through them so that even though the bags 7 are made of gas-impervious material it will be possible to aspirate steam generated during the ironing operation from the system. Even if the fittings 11 shift out of line with the respective holes 13 good gas aspiration is possible due to the nonsmooth finish of the bags 7.

Thus with the system according to the present invention it is possible to use a relatively long ironing path wherein the items 20 will be subjected to the heat from the chambers or radiant heaters 3. The advantageous features of pneumatic bags or cushions allow the items to be pressed effectively against the smooth inner surface of the sleeve 2, while the pressing band 23 ensures that nothing can remain lodged in the system on the drum 1, but that instead various items will be conveyed over a relatively long and smooth path to the outlet 6.

I claim:

1. An ironing mangle comprising:

an ironing roller having a generally cylindrical outer surface and rotatable about a roller axis in a predetermined rotational sense;

a sleeve surrounding said roller by more than 180° and having a generally cylindrical inner surface juxtaposed with and radially spaced outwardly from said outer surface of said roller;

a plurality of cushions each having an inner wall lying mainly on said outer surface, an outer wall between said inner wall and said inner surface of said sleeve, and a sealed periphery defining between said walls a pressurizable chamber;

mounting means for securing said cushions to said outer periphery at angularly offset locations for orbiting of said cushions about said axis on rotation of said roller; and means for feeding a gas under pressure into said chambers and thereby pressing an item to be pressed between said outer wall and said inner surface.

2. The mangle defined in claim 1, further comprising a cover sheet secured to said drum and lying between said outer walls and said inner surface.

3. The mangle defined in claim 2 wherein said sleeve surrounds said roller by more than 270°.

4. The mangle defined in claim 3 wherein said roller has a predetermined axial roller length and a predetermined circumferential roller dimension, said cushions each having a width measured parallel to said axis equal generally to said axial roller length and a length measured angularly of said axis equal to a fraction of said circumferential roller dimension.

5. The mangle defined in claim 4 wherein each of said cushions has relative to said rotational sense of said roller a leading edge extending generally parallel to said axis and secured by said mounting means to said roller and a trailing edge also generally parallel to said axis and overlying the leading edge of the following cushion, whereby each leading edge lies under the trailing edge of the leading preceding cushion and each trailing edge lies over the leading edge of each following cushion.

6. The mangle defined in claim 1 wherein said outer walls each have a radially outwardly directed face formed with a multiplicity of alternate bumps and hollows.

7. The mangle defined in claim 6, further comprising a steam-pervious cover sheet secured to said drum and lying between said outer walls and said inner surface, and means for aspirating steam through said cover sheet and past said cushions, and means for heating at least one of said surfaces.

8. The mangle defined in claim 7 wherein said means for aspirating includes tubular fittings extending through said cushions, having outer ends opening underneath said cover sheet, and having inner ends communicating with the interior of said roller.

9. The mangle defined in claim 8 wherein each of said tubular fittings extends generally radially and is formed at least partially as an axially compressible bellows, said outer and inner ends being respectively connected in gastight manner to the outer and inner walls of the respective cushions.

10. The mangle defined in claim 8 wherein said roller is cylindrically tubular and said means for aspirating includes a blower having an intake connected to said interior.

11. The mangle defined in claim 1, further comprising a cover sheet having relative to said rotational sense a leading edge secured to said roller and underlying one of said cushions and lying behind said leading edge over said cushions.

12. The mangle defined in claim 1 wherein each of said cushions is provided wth a pressurization nipple extending into said roller and connected to said means for feeding, said walls being of flexible, generally inelastic, and gas-impervious material.

13. The mangle defined in claim 1 wherein said roller is cylindrically tubular and formed with a plurality of angularly spaced throughgoing holes.

14. The mangle defined in claim 1, further comprising an endless pressing band and means for guiding a stretch of same between said outer walls and said inner surface.

15. The mangle defined in claim 14, further comprising a guide plate on said sleeve forming a reverse angular continuation of said inner surface and juxtaposed with said endless pressing band.

* * * * *